US011278138B2

(12) United States Patent
Yang

(10) Patent No.: US 11,278,138 B2
(45) Date of Patent: Mar. 22, 2022

(54) CONTAINER WITH REMOVABLE BASE ASSEMBLY

(71) Applicant: Zhejiang Hengfeng Top Leisure Co., Ltd., Wukang Town (CN)

(72) Inventor: Baoqing Yang, HangZhou (CN)

(73) Assignee: ZHEJIANG HENGFENG TOP LEISURE CO., LTD., Zhejiang (CN)

( * ) Notice: Subject to any disclaimer, the term of this patent is extended or adjusted under 35 U.S.C. 154(b) by 0 days.

(21) Appl. No.: 16/989,036

(22) Filed: Aug. 10, 2020

(65) Prior Publication Data

US 2022/0039574 A1 Feb. 10, 2022

(51) Int. Cl.
*A47G 19/22* (2006.01)

(52) U.S. Cl.
CPC ..... *A47G 19/2255* (2013.01)

(58) Field of Classification Search
CPC ..... A47G 19/2255; A47G 19/2261
USPC ..... 206/477
See application file for complete search history.

(56) References Cited

U.S. PATENT DOCUMENTS

2021/0145195 A1* 5/2021 Hakim ..... A47G 19/10

* cited by examiner

*Primary Examiner* — Andrew D Perreault
(74) *Attorney, Agent, or Firm* — Thompson Coburn LLP

(57) ABSTRACT

A container has a removable base assembly. The base assembly has a resilient portion. The base assembly is removably attachable to the container in a recess of the container. The base assembly being dimensioned to have a fixed fit with the recess such that when the base assembly is assembled with the container, the resilient portion is exposed from the recess allowing the container to be supported on a support surface by the resilient portion of the base assembly.

11 Claims, 6 Drawing Sheets

CONTAINER WITH REMOVABLE BASE ASSEMBLY

BACKGROUND AND SUMMARY

The disclosure is directed to a container having a base assembly. The base assembly may have a resilient portion. The base assembly is removably attachable to the container in a recess of the container. When the base assembly is assembled with the container, the resilient portion is exposed from the recess allowing the container to be supported on a support surface by the resilient portion of the base assembly.

and

Figure 3:
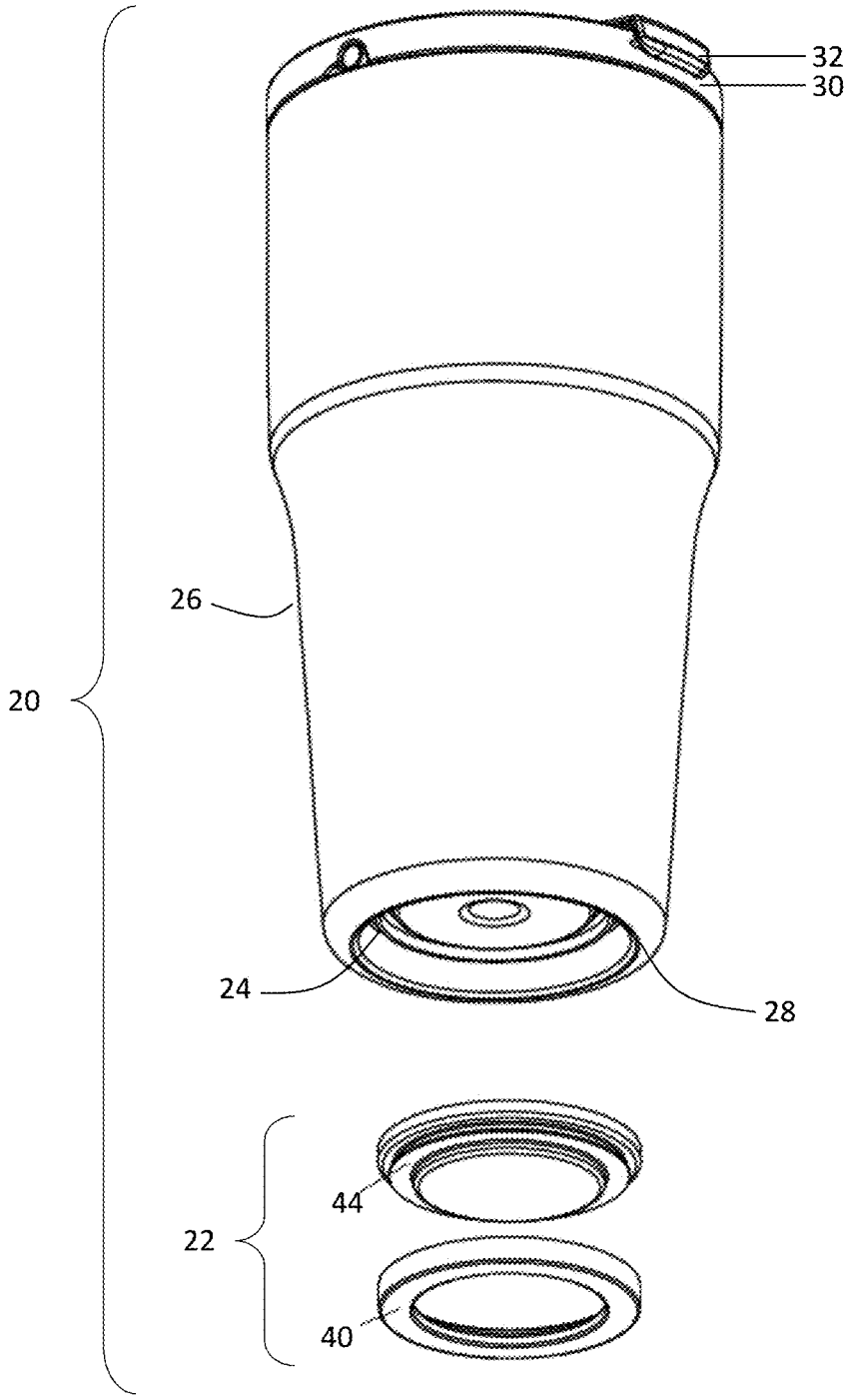
FIG. 3 is a further exploded perspective view of the container of FIG. 1 showing the resilient portion and the carrier of the base assembly exploded before forming the base assembly.
Figure 9:
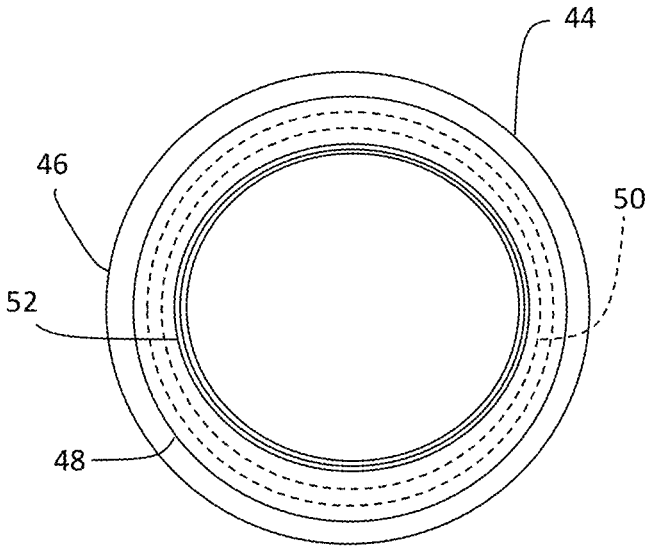

FIG. 9 is a bottom view of the carrier portion of the base assembly of FIG. 3.

DETAILED DESCRIPTION

Figure 1:
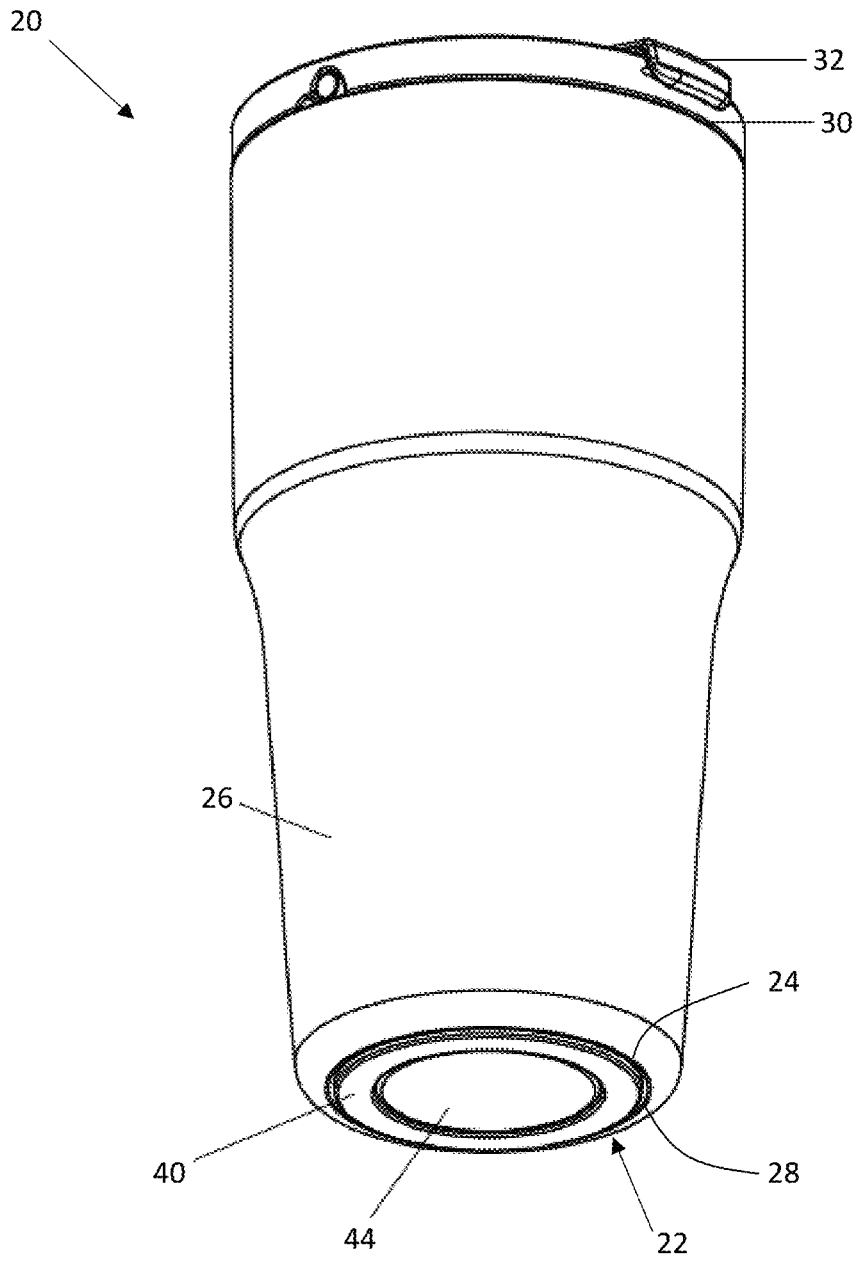
FIG. 1 is a perspective view of an exemplary container showing a base assembly assembled at a bottom of the container.
Figure 2:
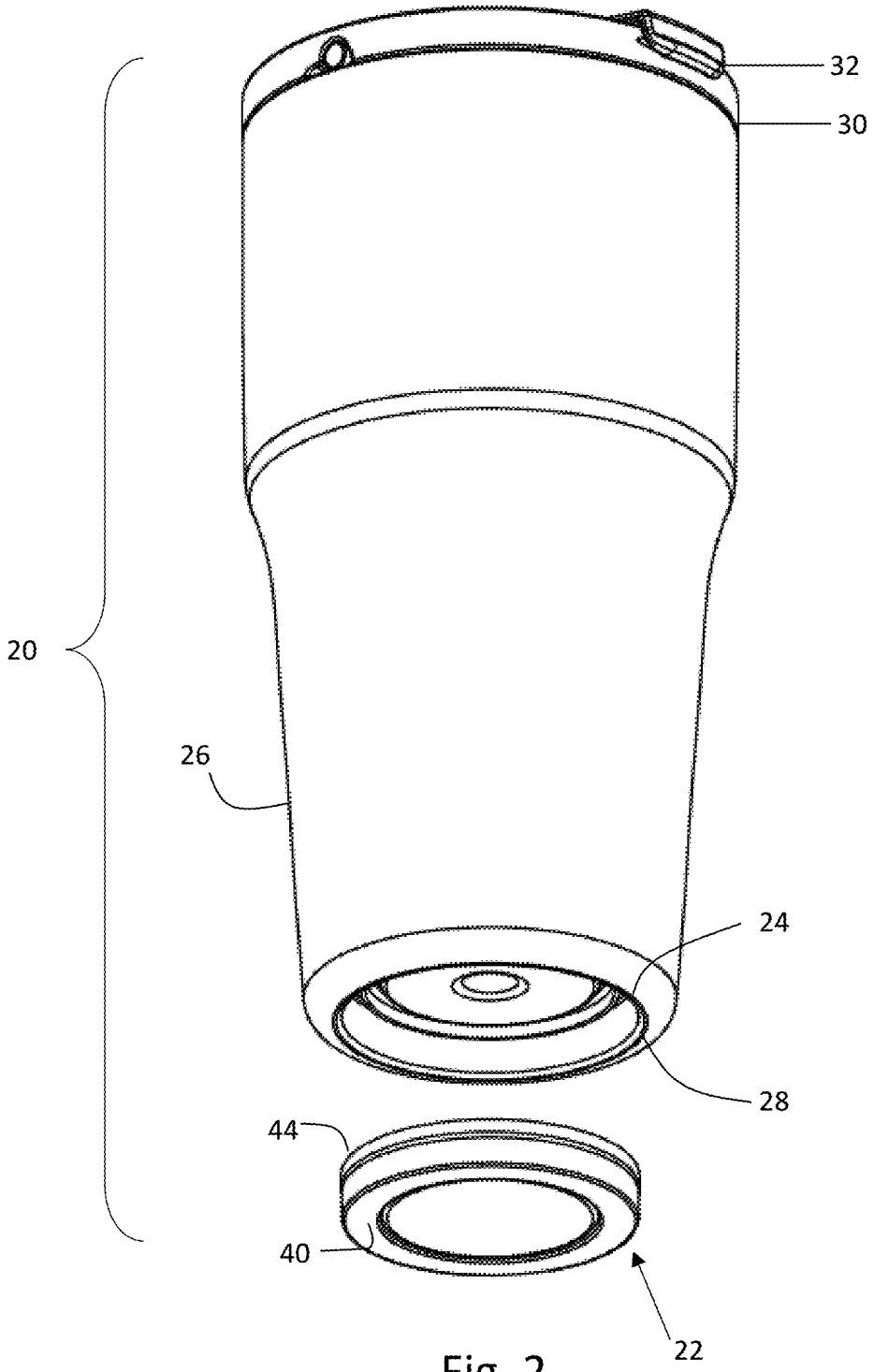
FIG. 2 is an exploded perspective view of the container of FIG. 1 showing the base assembly exploded before assembly with the container.

FIG. 1 shows an exemplary container 20 and a base assembly 22 inserted in a recess 24 of the container. The container 20 may be a beverage container, or another personal use container for containing fluids or solids, where there is a need to provide a cushion pad for vibration isolation, and non-skid type material on a surface of the container which is placed in contact with a support surface upon which the container is rested. In the exemplary container shown in the drawings, the container 20 has a sidewall 26 defining a volume of the container and a bottom 28 that extends below the sidewall when the container is upright. The container may be provided with a curving transition from the sidewall 26 to the bottom 28. The recess 24 that receives the base assembly 22 may be formed in the bottom 28. The depicted container also has a top 30 opposite the bottom and the top has an opening into the interior of the container, for instance for holding a beverage for the user. The container 20 may have a removable lid 32 covering the top opening. It should be appreciated that the container may have other shapes. For instance, the container may be formed like stemware where the sidewall does not extend to the bottom of the container but extends from the top to a stem and the stem extends from the sidewall to the bottom. In this configuration, the base assembly described herein may be inserted in a recess at the bottom.

The base assembly 22 may have a resilient portion 40. The resilient portion may comprise a cushion pad, and may be of a non-skid type material. The resilient portion 40 may be formed from a material with properties sufficient to provide vibration isolation, noise reduction, anti-skid/slip functions, and protection against fretting, sweating, condensation, water, rubbing and other damage to the surface on which the container is rested. For instance, the resilient portion 40 of the base assembly 22 may prevent sliding and water marks on a desktop or furniture item. The resilient portion 40 may be formed from a material that is compressible and elastically deformable, as will become evident from the discussion that follows. The resilient portion 40 may be cleanable with mild detergents, for instance, dish soap or in a dishwasher, should the resilient portion become soiled. The resilient portion 40 may be formed from a material that withstands moderate heat for instance, hot water cleaning, the drying cycle in a dishwasher, or a hot beverage. By way of example and not in any limiting sense, the resilient portion of the base assembly may be formed from silicone, rubber, polyurethane, or polyethylene.

The base assembly 22 may be removably attachable to the container 20 in the recess 24 of the container. Accordingly, the base assembly 22 may be dimensioned to have a mechanical transition fit with the recess 24. The mechanical fit may be a fixed fit where there is negligible clearance or a small interference fit between the base assembly and the recess so as to allow the base assembly to be assembled or disassembled with the recess with a light pressing force. The mechanical fit may be a similar fit where there is negligible clearance or a small interference fit between the base assembly and the recess so as to allow the base assembly to be assembled or disassembled with the recess with a more moderate pressing force that with the fixed fit. The mechanical fit may be a location fit where there is slight clearance between the base assembly and the recess so as to allow the base assembly to be assembled or disassembled with the recess with a snug or press fit. As shown in the drawings, the recess 24 is round and has a cylindrical bore. It should be appreciated that the recess 24 may be other shapes and/or may have a tapered bore. Accordingly, the base assembly 22 is similarly shaped and dimensioned to provide the desired mechanical fit with the recess 24.

By forming the recess 24 and the base assembly 22 to a have a mechanical fit, the base assembly may be removeably insertable into the recess. The base assembly 22 may be removed from the container 20 to allow the base assembly and container to be cleaned. This provides an advantage over conventional containers that adhere or glue, a protective mat to the bottom of the container. In the conventional container with adhered bottom mat, the container cannot often be washed, for instance, in hot water or in the hot drying cycle of a dishwasher, as the temperature and water degrade the adhesive or glue and cause the protective mat to fall off the container. The exemplary container 20 with removably attachable base assembly 22 eliminates the glue or adhesive, thereby eliminating a potentially toxic material. It also allows the user the opportunity to wash the container 20 and the base assembly 22 apart from one another and in hot water or a dish washer with a heat cycle, thereby ensuring a more thorough cleaning. The recess may be provided with an elongated slot (not shown) adjacent its periphery. The slot may be sized to accept a coin, key, or small tool to allow the user to pry the base assembly out of the recess for disassembly.

Figure 7:
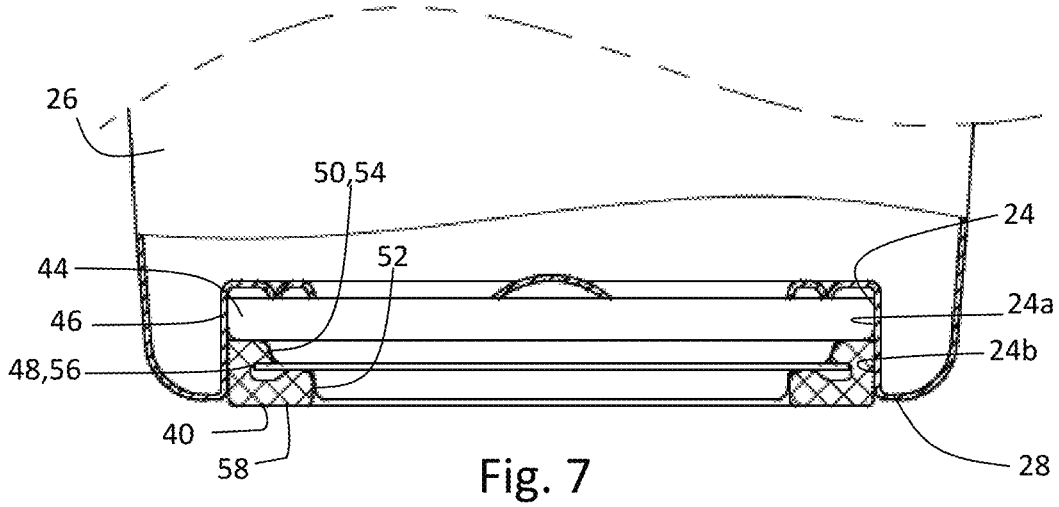
FIG. 7 is a partial, enlarged cross-sectional view of the container of FIG. 3 showing the base assembly received in the recess.

As shown in the drawings, the base assembly 22 includes a carrier 44, and the resilient portion 40 is removably connectable with the carrier. The carrier 44 may be formed from a stiffer and more durable material so as to support the more flexible, resilient portion 40 and enable the resilient portion to engage the recess with the mechanical fit as will be described below. By way of example, the carrier 44 may be formed from a plastic or metal such as aluminum or stainless steel. The carrier 44 may have an outer periphery which is shaped and dimensioned to be received in the recess 24 or a region of the recess 24*a* of the container so as to allow the base assembly 22 to have a mechanical fit with the recess or region 24*a*. In addition or alternative to, the resilient portion 40 may have an outer periphery which is shaped and dimensioned to be received in the recess 24 or a region 24*b* of the recess of the container so as to allow the base assembly 22 to have a mechanical fit with the recess or region 24*b*. In one example, the carrier 44 may be shaped and dimensioned to have a mechanical fit with one region 24*a* of the recess, and the resilient portion 40 may be shaped and dimensioned to have a mechanical fit with another region 24*b* of the recess. The level of mechanical fit of the resilient portion 40 and the carrier 44 with the respective region of the recess may be different or the same. In another example, the carrier may be shaped and dimensioned to have a mechanical fit with one region of the recess, and the resilient portion may be shaped and dimensioned to have clearance with another region of the recess. In another example, the carrier may be shaped and dimensioned to have clearance with one region of the recess, and the resilient portion may be shaped and dimensioned to have a mechanical fit with another region of the recess. The resilient portion may also have an interference fit with the recess or a portion of the recess given the flexible and compressible nature of the resilient portion. As shown in the drawings (see, e.g., FIG. 7), the carrier 44 may engage a first region 24*a* of the recess 24 and the resilient portion 40 may engage a second region 24*b* of the recess. In view of the configuration of the carrier 44 and the resilient portion 40, the resilient portion engages the second region 24*b* of the recess 24 adjacent to an opening of the recess and the carrier engages the first region 24*a* of the recess which is farther away from the opening and vertically above the second region.

Figure 4:
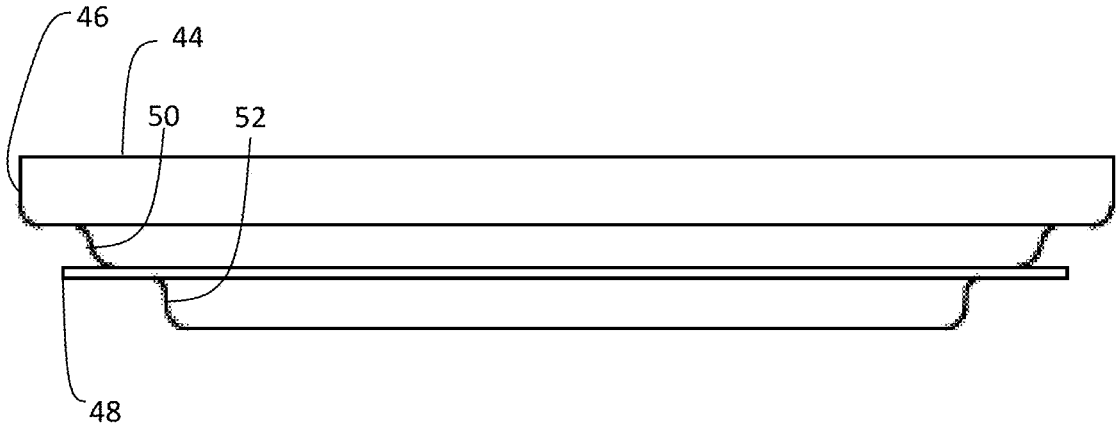
FIG. 4 is a side elevation view of the carrier of FIG. 3.
Figure 5:
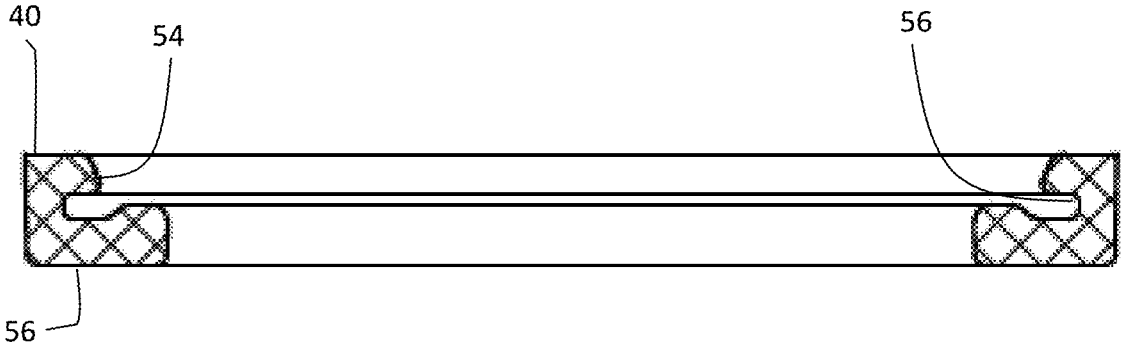
FIG. 5 is a side cross-sectional view of the resilient portion of FIG. 3.
Figure 6:
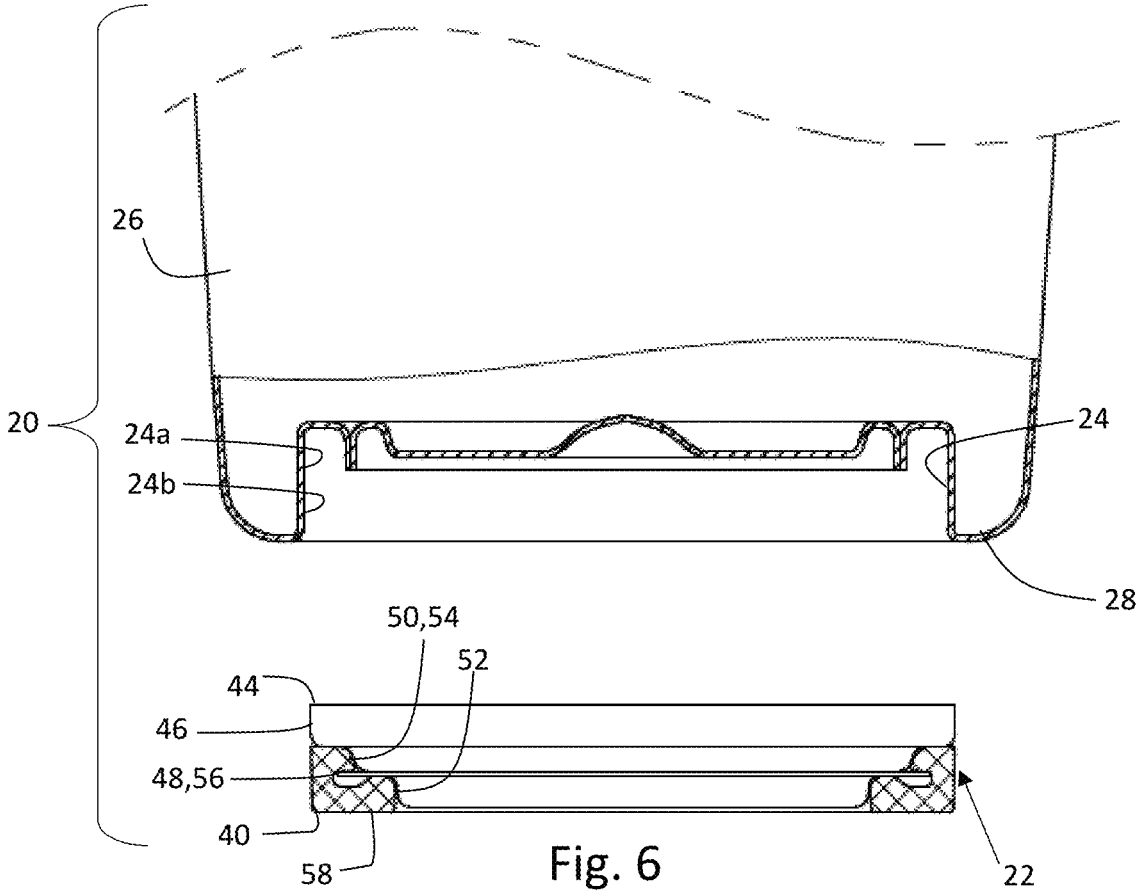
FIG. 6 is a partial, enlarged cross-sectional view of the container of FIG. 3 showing a recess of the container and the base assembly being positioned to be received in the recess.
Figure 8:
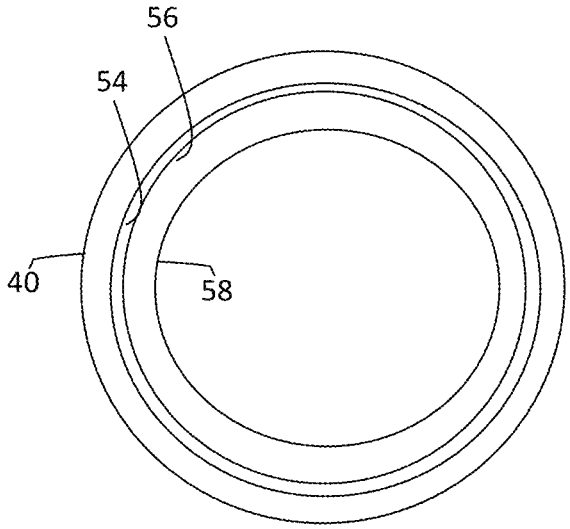
FIG. 8 is a top plan view of the resilient portion of the base assembly of FIG. 3.

Making reference to FIGS. 4 and 9, the carrier 44 may have a locator surface 46 on its outer periphery, for instance, to engage the recess or a region of the recess 24. The carrier 44 may also have an annular rim 48 axially spaced from the locator surface 46 by a groove 50. The carrier 44 may also have an annular land 52 axially spaced from the annular rim 48. The outer diameter of the locator surface 46 may be larger than outer diameter of the annular rim 48. The outer diameter of the annular rim 48 may be larger than outer diameter of the annular land 52. The locator surface 46, annular rim 48, and/or annular land 52 may be configured to allow the resilient portion 40 to be removably attached with the carrier 42. Making reference to FIGS. 5 and 8, the resilient portion 40 may have an annular lip 54 that is received in the groove 50 of the carrier 44 between the locator surface 46 and the annular rim 48 of the carrier. The resilient portion 40 may have an annular notch 56 that receives the annular rim 48 of the carrier. The annular notch 56 of the resilient portion 40 may be cut-out and otherwise relieved in an included area of the notch to accommodate the annular rim of the carrier 44, especially as the resilient portion is deformed and assembled with the carrier. The resilient portion 40 may also have an annular foot 58 that surrounds the annular land 52. The annular foot 58 of the resilient portion 40 may be cut-out and otherwise relieved to accommodate the annular land 52 of the carrier 44, especially as the resilient portion is deformed and assembled with the carrier. The resilient portion 40 may be sufficiently elastic and deformable to allow the user to stretch the resilient portion around the annular rim 48 of the carrier 44 so that the annular notch 56 of the resilient portion 40 fits around the annular rim of the carrier, the annular rim of the carrier is received in the annular notch 56 of the resilient portion, and the periphery of the resilient portion extends from adjacent to the locator surface 46 of the carrier across the annular groove 50 of the carrier and annular land 52 of the carrier with the annular foot 58 of the resilient portion sufficiently exposed from the recess 24 when the base assembly 22 is assembled with the container 20 to support the container on the annular foot 58 when the container is upright. Accordingly, the resilient portion 40 may be generally in the shape of a ring with a center opening or may be disk-like without a center opening. The carrier 44 may have other surfaces that allow the resilient portion 40 to be removably assembled with the carrier. For instance, the carrier may comprise a multi-piece assembly that screws or mechanically connects together with the resilient portion held on the carrier between the connected pieces of the carrier. While the drawings show generally circular configurations of the carrier and the resilient portion, and the operative surfaces of the carrier and resilient portion that allow the carrier and resilient portion to be assembled, the carrier and resilient portion may have other configurations as desired sufficient to allow the base assembly to have a mechanical fit with the recess of the container and to allow the carrier to be assembled with the resilient portion.

While various embodiments have been described above, it should be understood that they have been presented by way of example only, and not limitation. Thus, the breadth and scope of a preferred embodiment should not be limited by any of the above-described exemplary embodiments

What is claimed:

1. A container comprising:

a recess formed in the container, the recess having an opening and being defined by a recess interior surface, the recess interior surface having a first region and a second region, the second region of the recess interior surface being adjacent to the opening of the recess and the first region of the recess interior surface being spaced away from the opening by the second region and vertically above the second region when the container is upright; and a base assembly, the base assembly being removably attachable to the container and being receivable in the recess of the container, the base assembly having a resilient portion and a carrier, the resilient portion being removably connectable with the carrier, the carrier having an outward facing annular locator surface and an annular rim axially spaced from the outward facing annular locator surface by a groove, the carrier having an annular land axially spaced from the annular rim, the resilient portion having an annular lip and an annular foot axially spaced from the annular lip along a width of the resilient portion;

wherein when the resilient portion is removably connected with the carrier, the annular lip of the resilient portion is received in the groove of the carrier, and the annular foot of the resilient portion surrounds the annular land of the carrier;

wherein when the base assembly is removably attached to the container in the recess of the container: (i) the outward facing annular locator surface of the carrier engages the first region of the recess interior surface, the outward facing annular locator surface of the carrier is dimensioned to have a mechanical fit with the first region of the recess interior surface, (ii) the resilient portion faces the second region of the recess interior surface, (iii) the annular foot of the resilient portion is exposed from the opening of the recess allowing the container to be supported on a support surface by the annular foot of the resilient portion of the base assembly.

2. The container of claim 1 wherein the recess has a cylindrical bore.

3. The container of claim 1 wherein the container has a sidewall defining a volume of the container, and a bottom extending below the sidewall when the container is upright and the recess is formed in the bottom.

4. The container of claim 3 wherein the container has a top opposite the bottom and the top has an opening into the interior of the container.

5. The container of claim 1 wherein the resilient portion engages the second region of the recess interior surface, and the resilient portion is dimensioned to have a mechanical fit with the second region of the recess interior surface.

6. A container comprising:

a bottom and an opposite top, the bottom being below the top when the container is upright, the bottom having a recess, the recess having an opening and being defined by a recess interior surface, the recess interior surface having a first region and a second region, the second region of the recess interior surface being adjacent to the opening of the recess and the first region of the recess interior surface being spaced away from the opening by the second region and vertically above the second region when the container is upright; and a base assembly adapted and configured to be removably received in the recess, the base assembly having a resilient portion and a carrier, the resilient portion being removably connectable with the carrier, the carrier having an outward facing annular locator surface and an annular rim axially spaced from the outward facing annular locator surface by a groove, the carrier having an annular land axially spaced from the annular rim, the resilient portion having an annular lip and an annular foot axially spaced from the annular lip;

wherein when the resilient portion is removably connected with the carrier, the annular lip of the resilient portion is received in the groove of the carrier, and the annular foot of the resilient portion surrounds the outer annular land of the carrier;

wherein when the base assembly is removably received in the recess: (i) the outward facing annular locator surface of the carrier faces the first region of the recess interior surface, (ii) the resilient portion engages the second region of the recess interior surface, the resilient portion is dimensioned to have a mechanical fit with the second region of the recess interior surface, and (iii) the annular foot of the a resilient portion is exposed from the opening of the recess and provides a support upon which the container rests when the container is upright.

7. The container of claim 6 wherein the bottom recess has a cylindrical bore.

8. The container of claim 6 wherein the container has a side wall that extends between the top and the bottom.

9. The container of claim 8 wherein the side wall has a curving transition to the bottom.

10. The container of claim 6 wherein the top has an opening into the interior of the container.

11. The container of claim 6 wherein the outward facing annular locator surface of the carrier engages the first region of the recess interior surface, and the outward facing annular locator surface of the carrier is dimensioned to have a mechanical fit with the first region of the recess interior surface.

* * * * *